US012558606B1

(12) United States Patent
Sweeney et al.

(10) Patent No.: US 12,558,606 B1
(45) Date of Patent: Feb. 24, 2026

(54) BRACE TO IMPROVE HAND POSITIONING FOR SHORT GOLF GAME

(71) Applicant: DBL R GOLF, LLC, San Antonio, TX (US)

(72) Inventors: Rory Sweeney, Los Angeles, CA (US); Roger Cleveland, San Antonio, TX (US); Mario De La Cabada, San Antonio, TX (US)

(73) Assignee: DBL R GOLF, LLC, San Antonio, TX (US)

( * ) Notice: Subject to any disclaimer, the term of this patent is extended or adjusted under 35 U.S.C. 154(b) by 0 days.

(21) Appl. No.: 18/972,453

(22) Filed: Dec. 6, 2024

(51) Int. Cl.
*A63B 71/14* (2006.01)
*A41D 19/00* (2006.01)
*A41D 19/015* (2006.01)

(52) U.S. Cl.
CPC ..... *A63B 71/146* (2013.01); *A41D 19/0096* (2013.01); *A41D 19/01505* (2013.01); *A41D 19/01582* (2013.01); *A41D 19/01588* (2013.01)

(58) Field of Classification Search
CPC ..... A63B 71/146; A41D 19/0096; A41D 19/01505; A41D 19/01582; A41D 19/01588
See application file for complete search history.

(56) References Cited

U.S. PATENT DOCUMENTS 4,675,914 A * 6/1987 Mitchell ..... A41D 19/01588 2/161.1
5,499,820 A * 3/1996 Albertsson ..... A63B 69/0059 273/DIG. 30
5,537,692 A * 7/1996 Dorr ..... A41D 19/01588 2/161.1
5,561,856 A * 10/1996 Pesco ..... A41D 19/01588 2/21
5,745,916 A * 5/1998 Linner ..... A63B 71/143 2/161.1
11,291,907 B2 * 4/2022 Rocks ..... A41D 19/01523
11,771,153 B1 * 10/2023 Otto ..... A41D 13/084 2/161.2
11,826,626 B1 * 11/2023 Gankas ..... A63B 69/3608
12,059,367 B2 * 8/2024 Bruckmann ..... A61F 5/0118
12,251,328 B2 * 3/2025 Colditz ..... A61F 5/0118
2002/0042940 A1 * 4/2002 Kuroda ..... A63B 71/146 2/161.1
2005/0101898 A1 * 5/2005 Cohen ..... A61F 5/0118 602/21

(Continued)

*Primary Examiner* — Khaled Annis
(74) *Attorney, Agent, or Firm* — Vedder Price P.C.

(57) ABSTRACT

A hand brace to improving a golfer's short game is disclosed. The brace comprises a shell, a first guard and a second guard. The shell is flexible and configured to cover at least a back portion of the golfer's dominant hand, top of the wrist and lower forearm. The first guard is physically associated with the shell extending along the back of the golfer's dominant hand from and between proximately the second knuckles of the index and ring fingers, over the top of the dominant wrist and lower forearm. The first guard substantially restricts maximum extension of the golfer's dominant wrist to less than approximately 20 degrees. The second guard is physically associated with the shell extending along the back of the golfer's thumb from the nailbed to the first knuckle to substantially restrict radial deviation of the golfer's dominant wrist to less than approximately 10 degrees.

16 Claims, 10 Drawing Sheets

(56) References Cited

U.S. PATENT DOCUMENTS

| | | | | |
|---|---|---|---|---|
| 2010/0192279 | A1* | 8/2010 | Hunsicker | A63B 71/146 2/161.2 |
| 2021/0299544 | A1* | 9/2021 | Rocks | A41D 19/015 |

* cited by examiner

BRACE TO IMPROVE HAND POSITIONING FOR SHORT GOLF GAME

FIELD OF THE INVENTION

The present invention is generally directed to sporting goods and more specifically to a training aid for use in improving skill within the game of golf.

BACKGROUND

The modern game of golf has been played for more than five centuries. The object of the game of golf is well-known: the players (called golfers) use various clubs to hit a ball—using as few strokes as possible—from a starting point (often called a "tee box") to a finishing point that usually comprises a cup (called a "hole") in an area of very closely trimmed grass (called a "putting green" or "green"). A round of golf generally consists of 18 such pathways, each pathway also being referred as a hole.

The distance between a tee and its associated cup varies by hole. And, each hole may have one or more different types of terrain (e.g., short or tall grass) and hazards (e.g., trees, water features, sand-filled bunkers) between the tee and the cup to make each hole unique and introduce additional challenges.

The clubs used in golf have a shaft with a grip at the top end of the shaft and a club head at the bottom end of the shaft. Golf clubs are generally divided into three types: woods, irons, and putters. Woods are used to propel the ball a longer distance. As such, they have a longer shaft and larger club head (usually made a wood). Irons are usually shorter than woods. They have a generally flat, angled face (usually made of steel). As such, irons are used for shorter-distance shots, often to get the ball out of or away from a hazard or undesirable terrain. Putters are special iron designed to roll the golf ball along the putting green.

One aspect of the game of golf is called the "short game." The short game is really a group of skills that are used to move a golf ball a shorter distance such as when the ball is already close to the hole, stuck in a hazard, or a nearby hazard impedes the direct path between the current position of the golf ball and the hole. A short game comprises techniques referred to as putting, chipping and pitching.

Effective chipping and pitching techniques require specific placement of a golfer's dominant hand about the grip of the golf club lower down the shaft than their non-dominant hand. In particular, improved chipping and pitching comes from the golfer controlling the width of the wrist movement of their dominant hand to create a shallow angle of attack while creating a wide swing arc.

SUMMARY OF THE DISCLOSURE

There is a need in golf for a training aid device that assists a golfer in practicing short golf game. These as well as other needs in the art may be addressed by the systems and methods disclosed by the present disclosure as will be recognized by those of ordinary skill in the art after reviewing the present disclosure.

The present disclosure is directed to a hand brace to assist a golfer in improving their short game skills. The hand brace comprises a shell, a first guard and a second guard.

The shell is configured to cover at least a back portion of the golfer's dominant hand, a top portion of their dominant wrist, and a top portion of their dominant forearm. The shell has an inner layer and an outer layer and is constructed from at least one flexible material. Each layer of the shell may be formed from different flexible materials. These different flexible materials may be comprised of natural materials, synthetic materials or combinations thereof.

The first guard is disposed in association with the shell so that it extends along the back of the golfer's dominant hand from and between proximately the second knuckles of the index and ring fingers, over the top of the golfer's dominant wrist and extending toward a lower portion of the golfer's dominant forearm. The first guard is constructed to substantially restrict the maximum extension of the golfer's dominant wrist to less than approximately 20 degrees. The first guard may be disposed between the inner and outer layers of the shell. The first guard may be formed from a sufficiently hard material to provide a sufficiently rigid impediment to substantially prevent undesirable extension of the wrist.

The second guard is disposed in association with the shell so that it extends along the back of the thumb on the golfer's dominant hand from its nailbed to its first knuckle to substantially restrict radial deviation of the golfer's dominant wrist to less than approximately 10 degrees. The second guard may be disposed between the inner and outer layers of the shell. The second guard may be formed from a sufficiently hard material to provide a sufficiently rigid impediment to substantially prevent undesirable radial deviation.

The hand brace may further comprise a wrist strap. The wrist strap extends substantially perpendicularly from an edge of the shell proximate the dominant wrist of the golfer. The wrist strap is substantially formed from a flexible, elastic material. The wrist strap is operatively associated with recloseable mated fastening system. The recloseable mated fastening system may be a hook and loop closure.

The hand brace may further comprise a finger loop for receiving at least two fingers of the dominant hand. The finger loop may be a relatively narrow piece of flexible, elastic material that may be attached to opposing sides of the inner layer of the shell to engage the at least two fingers. The hand brace may further comprise a thumb loop for receiving the thumb of the dominant hand. The thumb loop may be attached to the inner layer of the shell. The finger and thumb loops may be removably attached to the shell.

These and other features of the invention will be understood by those of ordinary skill in the art having the present specification and drawings before them.

DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

FIG. 1 illustrates one potential embodiment of hand brace (100) for improving hand positioning for a short golf game, wherein the shell (110) of the hand brace is deployed over the right (dominant) hand of an individual holding the shaft of a golf club in both hands.

FIG. 2 is an elevational top view of the one potential embodiment of hand brace 100 illustrating, among other things the general placement of a first guard (115) and a second guard (120) within the layers of shell 110 (in phantom) and the exposed hooks (161) of the hook-and-loop fastener system of the wrist strap (150) used in one potential embodiment of the hand brace 100.

FIG. 3A is a perspective top view of the one potential embodiment of the hand brace 100 illustrating the concavity formed in the top of brace 100 by first guard 115 and further showing the wrist strap.

FIG. 3B is a perspective bottom view of the one potential embodiment of the hand brace 100 illustrating the inner surface (112), the finger loop (130) and the thumb loop (140) of the brace.

FIG. 3C is a perspective bottom view of the one potential embodiment of the hand brace 100 with three fingers and the thumb of a golfer's right hand disposed within the finger loop 130 and thumb loop 140, respectively.

FIGS. 3D and 3E together show the placement of first guard 115 within the inner layer (112) and outer layer (111) of the one potential embodiment of hand brace 100.

FIGS. 3F and 3G together show the placement of second guard 120 within the inner layer 112 and outer layer 111 of the one potential embodiment of hand brace 100.

DETAILED DESCRIPTION

Figure 1:
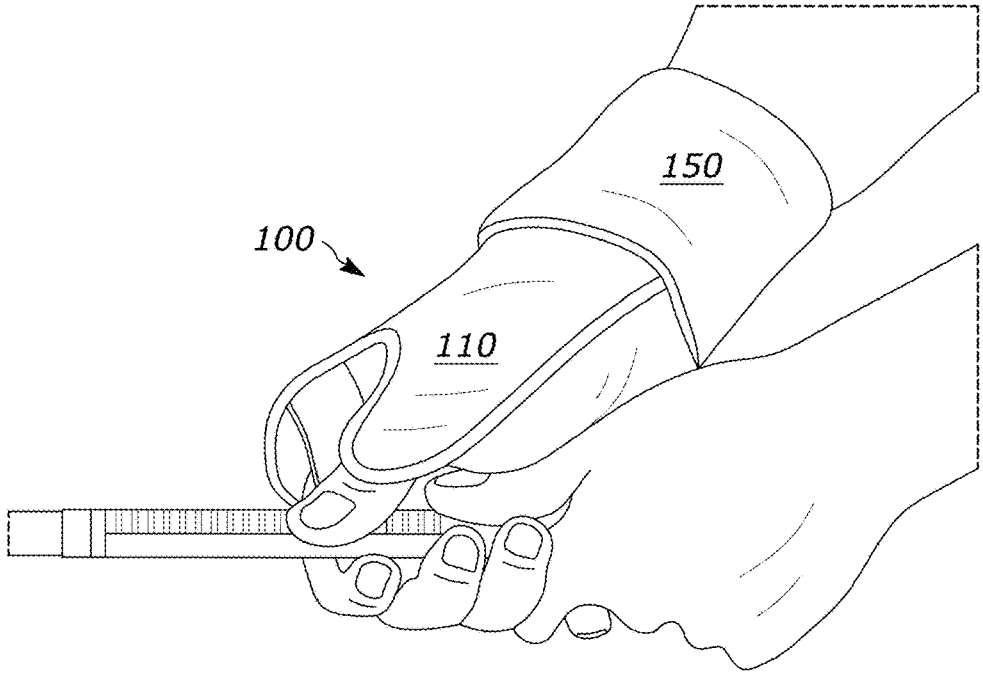
Figure 2:
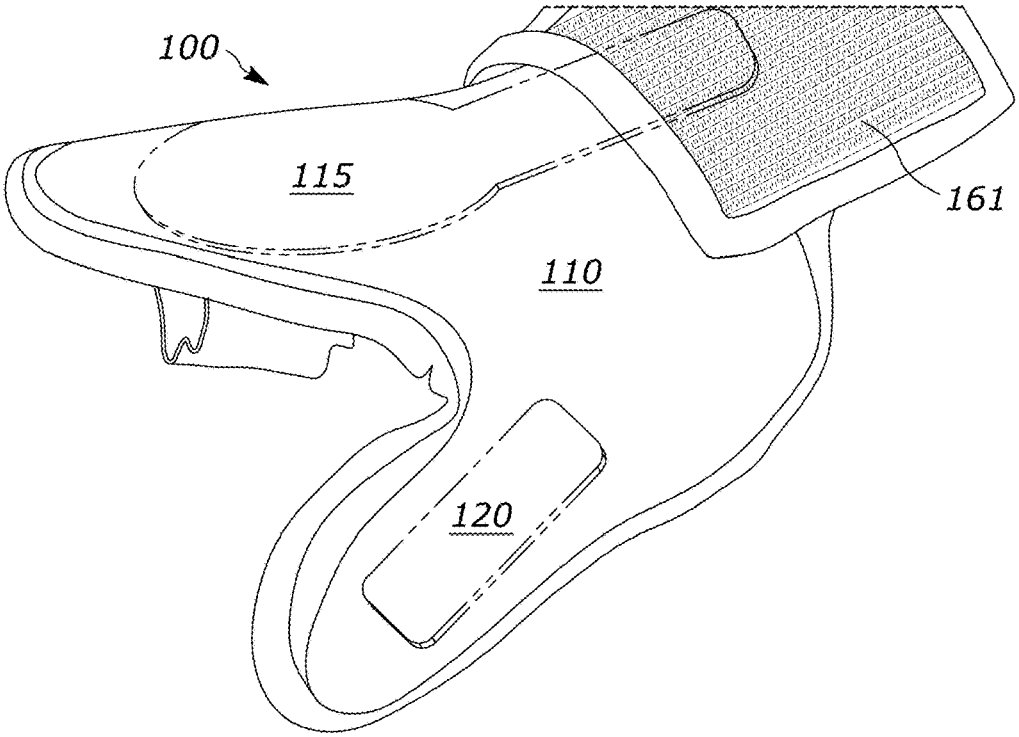

This invention may be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as systems, methods or devices. The following detailed description is, therefore, not to be taken in a limiting sense.

In the following detailed description of embodiments of the inventive concepts, numerous specific details are set forth in order to provide a more thorough understanding of the inventive concepts. However, it will be apparent to those of ordinary skill in the art having the present specification before them that the inventive concepts explicitly set forth within the disclosure may be practiced without certain of the specific details provided. In other instances, certain features well-known by those in the relevant art may not be described to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

The term "and combinations thereof" as used herein refers to all permutations or combinations of the listed items preceding the term. For example, "A, B, C, and combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. Those of ordinary skill in the art having the present specification before them will understand that typically there is no limit on the number of items or terms in any combination, unless otherwise apparent from the context.

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

The use of the terms "at least one" and "one or more" will be understood to include one as well as any quantity more than one, including, but not limited to, each of, 2, 3, 4, 5, 10, 15, 20, 30, 40, 50, 100, and all integers and fractions, if applicable, therebetween. The terms "at least one" and "one or more" may extend up to 100 or 1000 or more, depending on the term to which it is attached; in addition, the quantities of 100/1000 are not to be considered limiting, as higher limits may also produce satisfactory results.

Further, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

FIGS. 1-3G together illustrate the components of hand brace 100 in the context of one potential embodiment. In the embodiment illustrated, the hand brace 100 comprises a shell 110 having an outer layer 111 and inner layer 112, a first guard 115 and a second guard 120 both disposed between the inner and outer layers of the shell 110, a finger loop 130, a thumb loop 140, a wrist strap 150, and a fastening system 160. The hand brace 100 constructed to control the width of a golfer's wrist movements on their dominant hand to create a shallow angle of attack while creating a wide swing arc As most clearly illustrated in FIG. 3B, shell 110 is a flexible piece of material that covers at least the back of a golfer's dominant hand, thumb, top of the golfer's dominant wrist and top of the golfer's dominant forearm. The shell 110 has at least two layers: the outer layer 111 and the inner layer 112. The layers of shell 110 may be simply sewn together with stitching about the periphery of shell 110. In the embodiment illustrated, piping (i.e., a strip of folded fabric) was added into the seam about the periphery of shell 110.

Figure 3A:
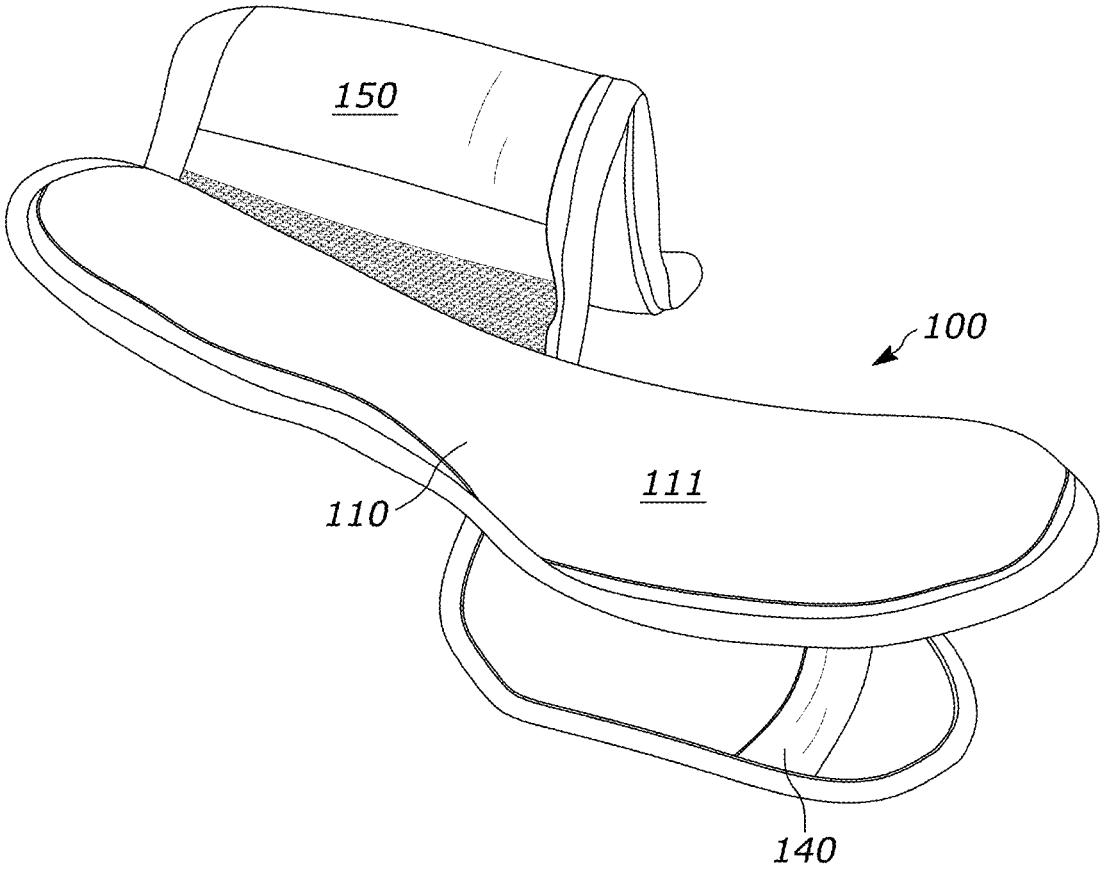
Figure 3B:
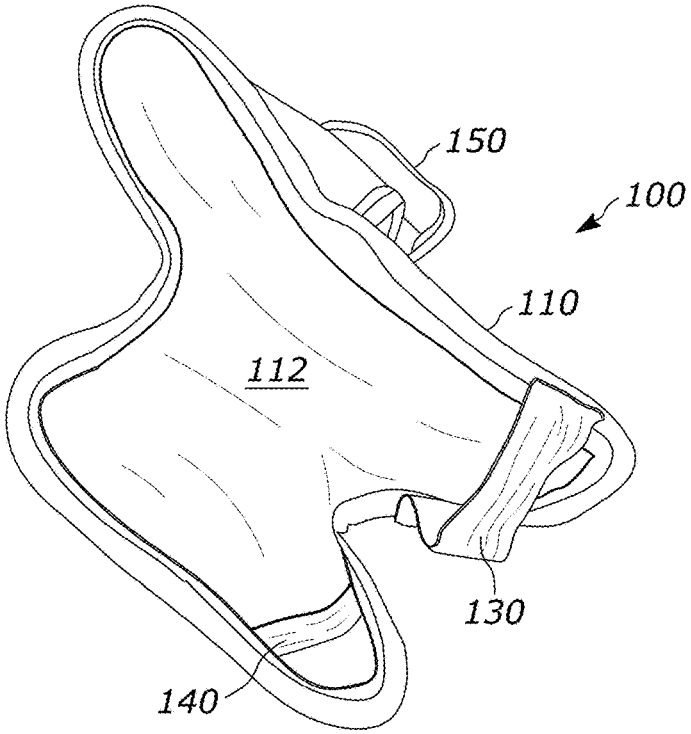
Figure 3C:
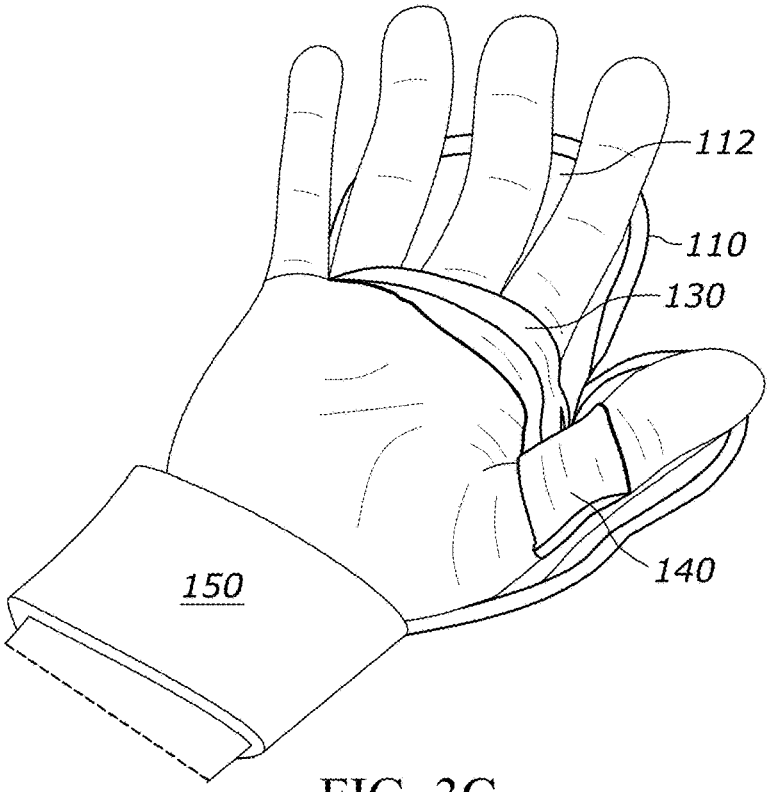
Figure 3D:
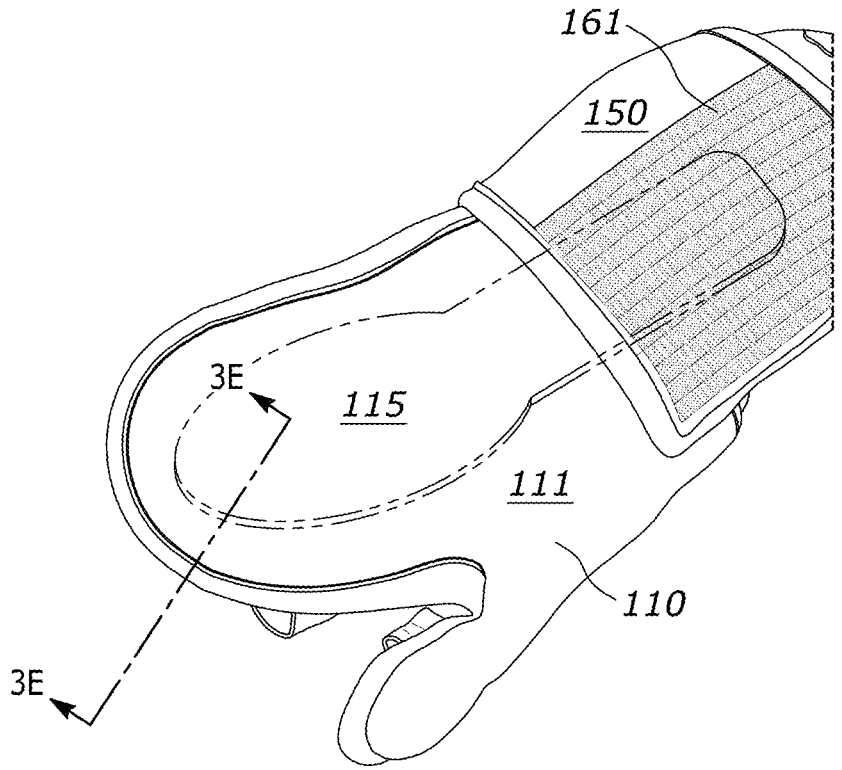
Figure 3E:
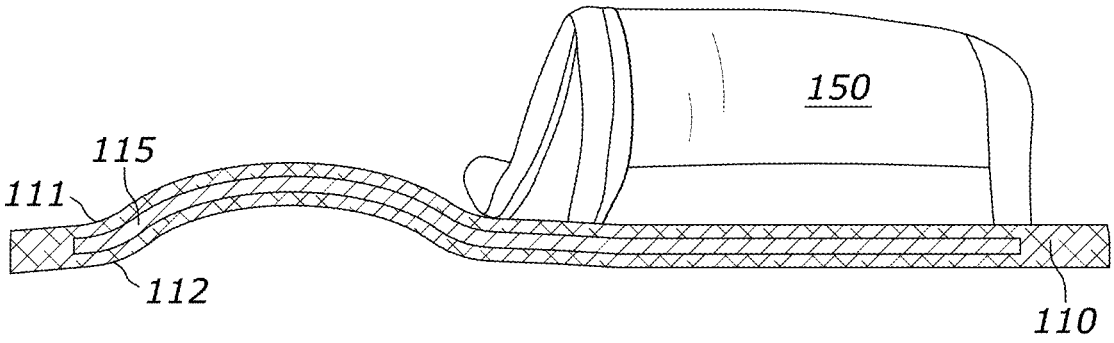
Figure 3F:
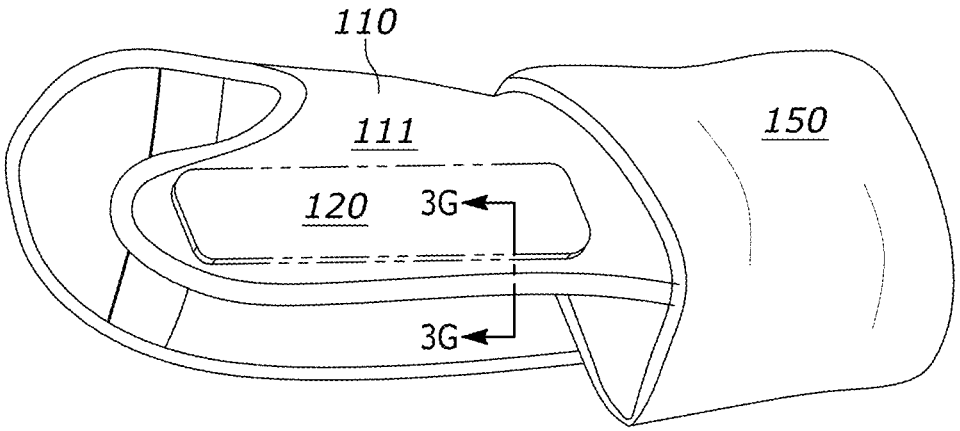
Figure 3G:
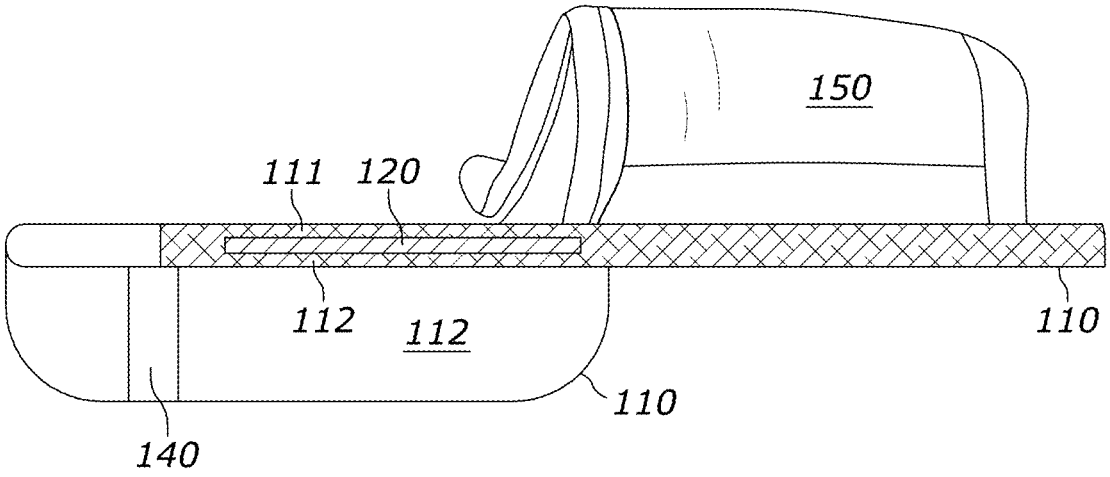

Each layer of the shell 110 may be formed from the same flexible material (as illustrated in the embodiment of FIGS. 3E and 3G) or they may be formed from different flexible materials. The flexible materials may be comprised of natural materials/fibers, synthetic materials/fibers or blends/combinations thereof including, but not limited to: bamboo, canvas, cotton, elastane (including Lycra® and Spandex® brands), elastic/stretch knit, jersey, leather, modal fabric, neoprene, nylon, polyester, polyethylene, polypropylene, polyurethane, rayon, and wool. The fabric for the inner layer 112 of the shell 110 may be particularly selected for moisture wicking capabilities. The fabric for both inner and outer layers may also be selected for their breathability. In all embodiments, it is contemplated that the fabric used may also provide compression about any or all of the golfer's hand, thumb, wrist, and forearm. In embodiments with piping, the fabric used for the piping may be the same fabric as the outer layer 111, the inner layer 112, both (where they are the same fabric) or neither the outer or inner layer. The color of all of the fabrics used may be the same, similar or different.

As illustrated in FIGS. 3D and 3E, the first guard 115 is disposed within the shell 110 between the outer layer 111 and inner layer 112 extending along the back of the golfer's hand from and between proximately the second knuckles of the index and ring fingers, over the top of the dominant wrist and toward the lower portion of the dominant forearm of the golfer. The first guard 115 is positioned and shaped to restrict the maximum extension (i.e. backwards movement) of the golfer's dominant wrist to less than approximately 20 degrees (measured as the arc between an imaginary line extending out from the line of the forearm and the plane extending along the fingers). The first guard 115 is preferably formed from a sufficiently hard material (e.g., hard plastic, carbon fiber, or metal) to provide a sufficiently rigid impediment to stop backwards movement (extension) of the wrist.

In the illustrated embodiment, first guard 115 has a shape reminiscent of the wooden spoon in single-serve ice cream cups with a rounded, slightly bulbous head and slightly narrow stem. In this embodiment, the rounded portion of first guard 115 is convex, curving outward toward the back of the golfer's hand thus providing a slightly angled surface to impede the extension of the wrist.

As illustrated in FIGS. 3F and 3G, the second guard 120 is disposed within the shell 110 between the outer layer 111 and inner layer 112 in substantial alignment over the thumb of the golfer from the nailbed to the first knuckle to restrict radial deviation (i.e. sideways movement) of the golfer's wrist to less than approximately 10 degrees (measured as the arc between an imaginary line extending out from the midline of the top of the golfer's forearm and the plane extending along the fingers). The second guard 120 is preferably formed from a sufficiently hard material (e.g., hard plastic, carbon fiber, or metal) to provide sufficient impediment to stop any further radial deviation. The material used for the first and second guards may be the same or it may be different. It may be molded, cut, or otherwise fashioned.

In some potential embodiments of the hand brace, either or both of the first and second guards may be removed and reinserted into the shell 110 to facilitate cleaning of the shell. In some potential embodiments of the hand brace, either or both of the first and second guards may be disposed on the outside of the outer layer of the shell 110. In these embodiment, either or both of the first and second guards would be visible.

As illustrated in FIGS. 3B and 3C, the finger loop 130 is a relatively narrow piece of flexible, elastic material attached to opposing sides of the inner layer 112 (preferably in association with the piping) proximate the forwardmost edge of shell 110 to engage two or three of the middle (i.e., index, middle, and/or ring) fingers of the golfer (see, e.g., FIG. 3C). The finger loop 130 is dimensioned to provide room to receive the two or three fingers, but it is not necessary that the finger loop 130 be dimensioned and/or sufficiently taut so as to apply positive pressure to push the backs of the golfer's fingers toward the inner layer 112 of the shell 110. One or both ends of the finger loop may be permanently attached to the inner layer of the shell 110. Alternatively, one or both ends of the finger loop may be removably attached to the inner layer of the shell 110, as may be desirable to allow for easier donning of the hand brace and/or easier replacement of the finger loop 130.

As illustrated in FIGS. 3B and 3C, the thumb loop 140 is a relatively narrow piece of flexible, elastic material attached to opposing sides of the inner layer 112 (preferably in association with the piping) proximate the forwardmost edge of shell 110 to engage the golfer's thumb (see, e.g., FIG. 3C). The thumb loop 140 is dimensioned to provide room to receive the thumb, but it is not necessary that the thumb loop 140 be dimensioned and/or sufficiently taut so as to apply positive pressure to push the back of the golfer's thumb toward the inner layer 112 of the shell 110. One or both ends of the thumb loop may be permanently attached to the inner layer of the shell 110. Alternatively, one or both ends of the thumb loop may be removably attached to the inner layer of the shell 110, as may be desirable to allow for easier donning of the hand brace and/or replacement of the thumb loop 130.

As illustrated in FIG. 3A, the wrist strap 150 extends substantially perpendicularly from an edge of the shell 110 to form an adjustable mechanism for fastening hand brace 100 about the forearm of the golfer. The wrist strap 150 may be formed from a flexible, elastic material. At the end of the wrist strap 150 proximate the outer fabric 111 is positioned the first part of a recloseable mated fastening system 160. The second part of the recloseable mated fastening system is position toward the distal end of the wrist strap 150. The first or second part of the recloseable mated fastening system may be the female portion of the system, while the other part is the male portion.

In some embodiments, the wrist strap 150 may comprise two or more straps each having an associated recloseable mated fastening system.

In the embodiment illustrated by the figures, the mated fastening system is a hook and loop fastening system (e.g., VELCRO®) wherein the hooks 161 are located proximate the shell 110 and the loops are located proximate the distal end of the wrist strap (not shown). As would be understood by those in the art having the present specifications and drawings before them, the portion of the mated fastening at the distal end may be elongated to accommodate snug adjustment to the diameter of the golfer's forearm. In another embodiment also utilizing hook and loop fastening, one or more o-rings may be adhered along a first edge of shell 110 while a corresponding number of hook & loop straps (no wider than the opening of the o-rings) are attached to the opposite edge of shell 110 such that the strap may be fed through a corresponding o-ring, looped back toward the opposite edge and tightened until the hooks and loops are attached together.

Figure 4:
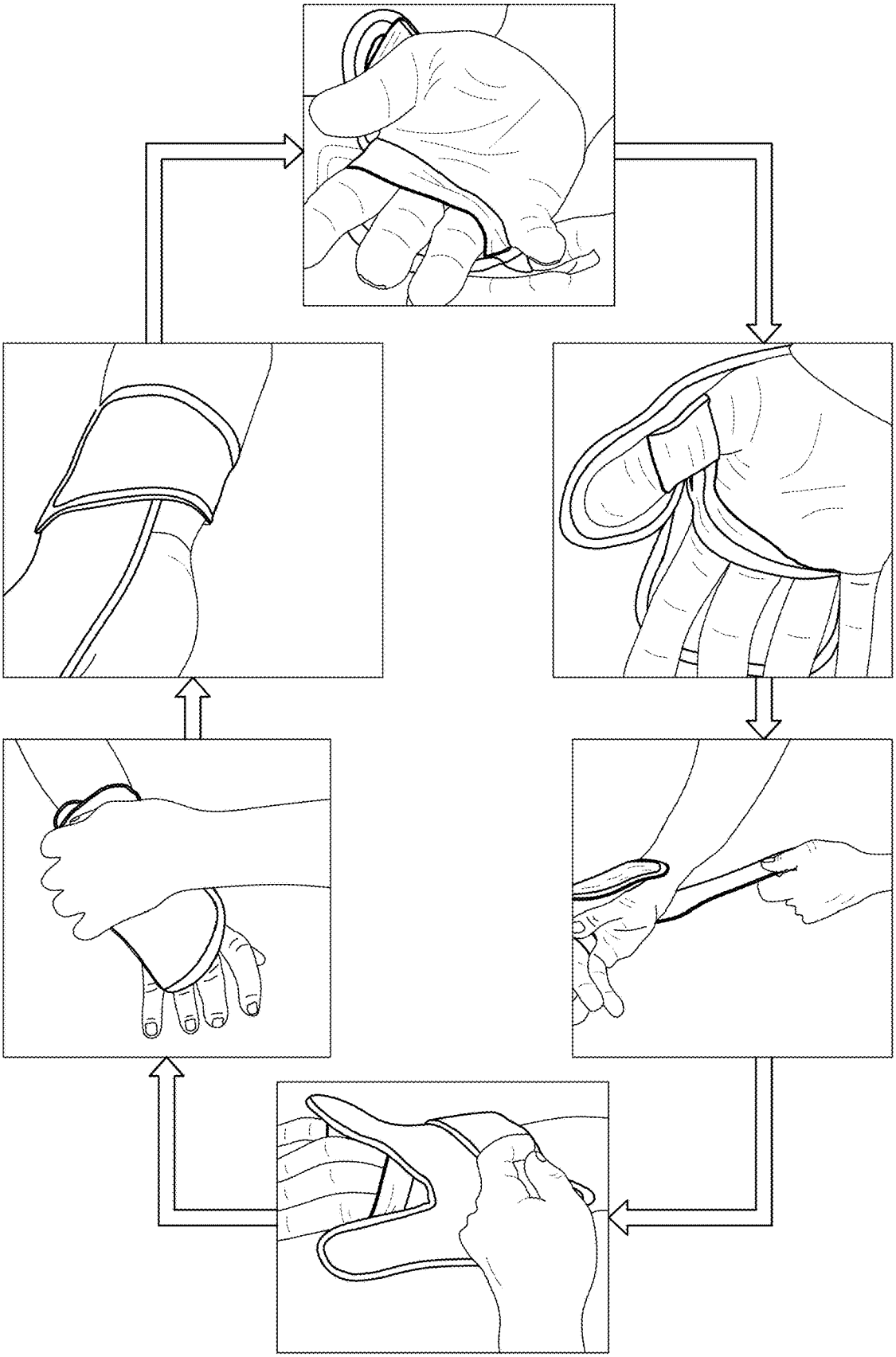
FIG. 4 is a block diagram illustrating the steps associated with the donning of hand brace 100 on the right (dominant) hand of a golfer.

FIG. 4 is a block diagram generally illustrating the steps associated with the donning of hand brace 100 on the right hand of a golfer who is right-hand dominant. Beginning at the top of FIG. 4, the user is illustrated sliding three fingers between the inner layer 112 of shell 110 and finger loop 130. (As noted above, the user may elect to slide only two fingers into the finger loop 130.) Continuing clockwise within FIG. 4, the user is illustrated sliding their thumb between the inner layer 112 of shell 110 and thumb loop 140. Still continuing clockwise, the user then grabs wrist strap 150 wrapping it around their forearm and shell 110. The next two vignette of FIG. 4, show the user attaching the fastening system 160 to fasten the hand brace 100 about the golfer's hand, wrist, and forearm. The final vignette of FIG. 4 illustrates the fully fastened brace.

FIGS. 5-8 together illustrate another potential embodiment of the hand brace (500), wherein both the first guard (515) and second guard (520) are formed by a unified sheet of plastic (517) disposed between the layers of the shell (510). Any type of plastic may be used so long as the sheet presents sufficient stiffness to the to limit maximum extension and radial deviation of the user's hand, as disclosed above. The plastic used is preferably capable of being thermoformed. In particular, the unified sheet of plastic may comprise a high impact polystyrene (HIPS), which may have a thickness of 1/32". Other types of plastic that may be used include, but are not limited to, ABS (acrylonitrile butadiene styrene), fiberglass, PETG (polyethylene terephthalate glycol), or polycarbonate (Lexan®). The unified sheet of plastic may also have a layer of open cell foam disposed thereon. The unified sheet of plastic may be formed from more than one sheet of plastic. It is also possible that more than one type of plastic may be used in the unified sheet of plastic.

In one approach to this potential embodiment, the unified sheet of plastic may be thermoformed about a mold of a generalized human hand. In other approaches to this potential embodiment, the unified sheet of plastic may be formed by compression molding, injection molding or fiberglass molding. The unified sheet may be trimmed after molding.

Figure 6:
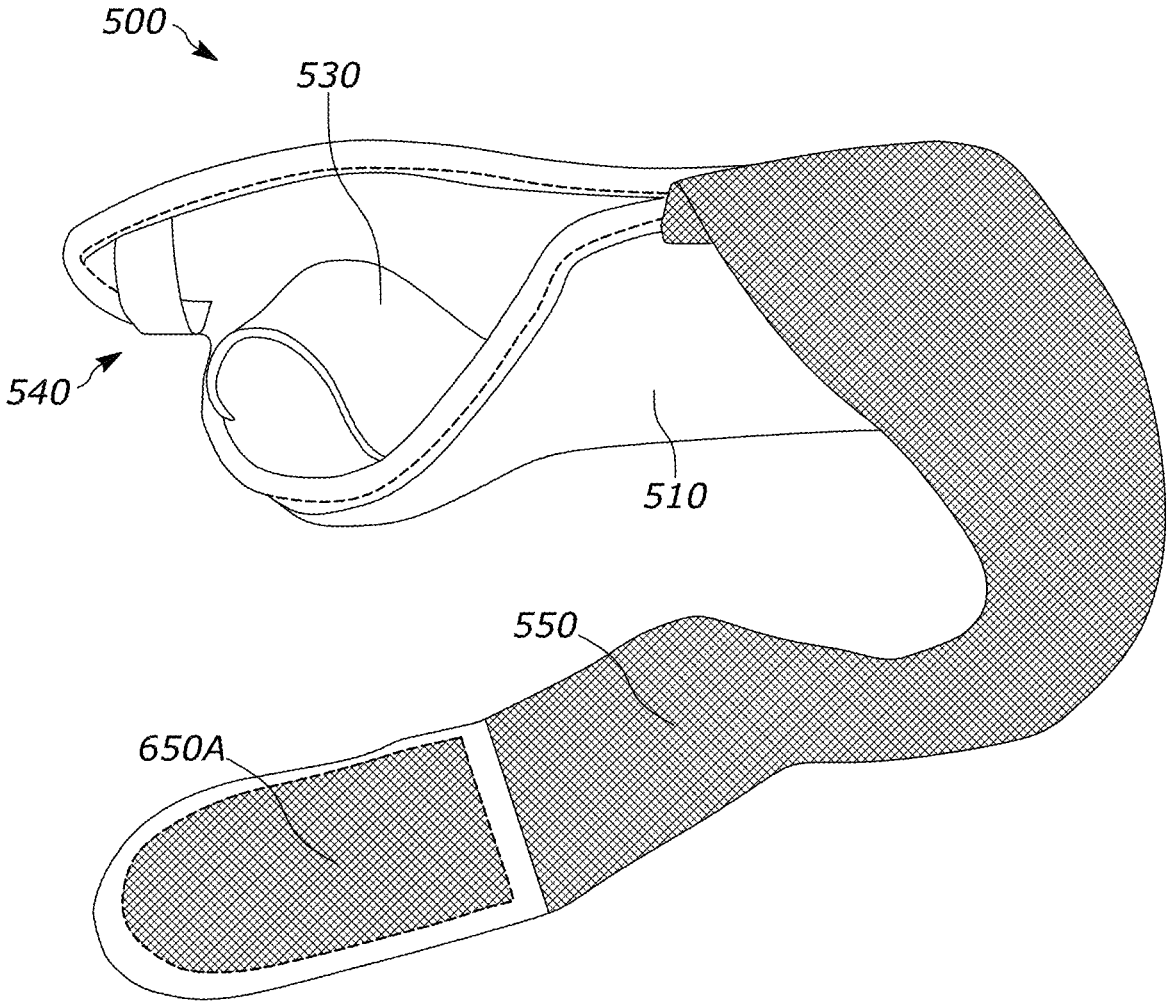
FIG. 6 is a second perspective view illustrating the potential embodiment of the hand brace 500, illustrated in FIG. 5.
Figure 7:
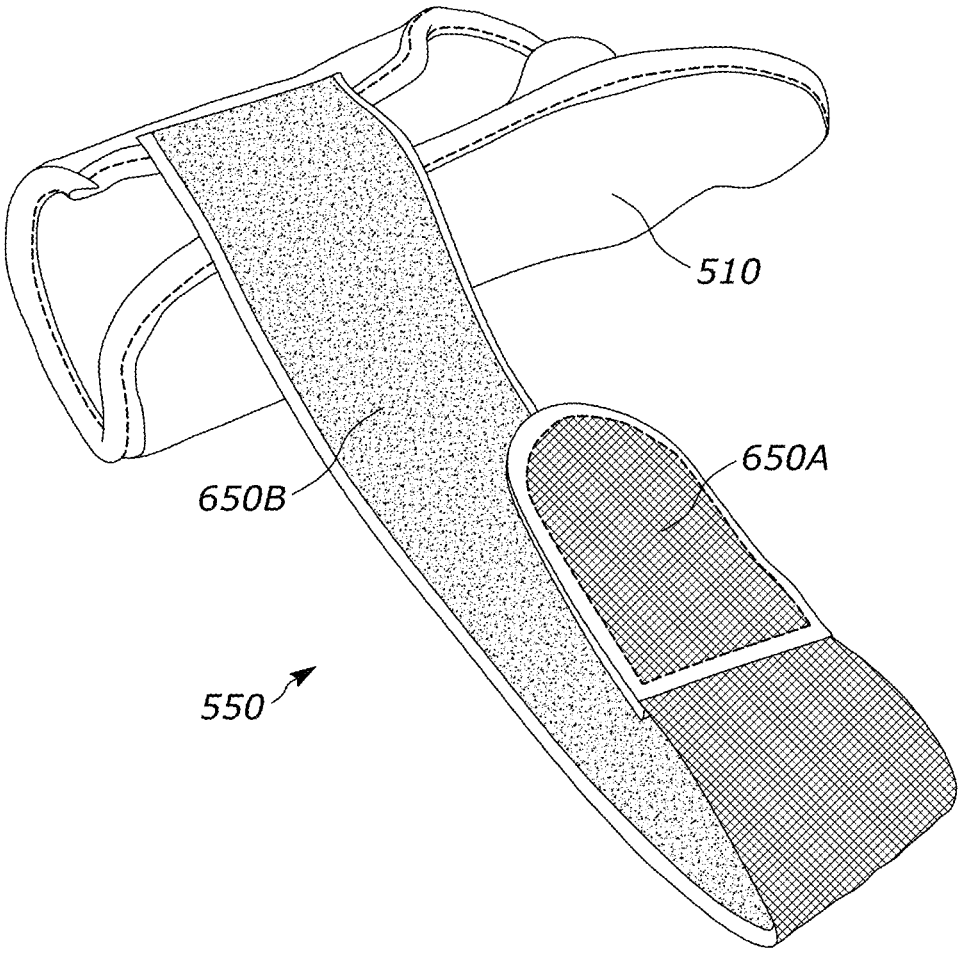
FIG. 7 is a third perspective view illustrating the potential embodiment of the hand brace 500, as illustrated in FIG. 5.

After the unified sheet of plastic 517 has been formed, it may be incorporated into shell 510 between outer layer 511 and inner layer 512. In one embodiment, the unified plastic sheet may be sewn into the shell. The hand brace 500 has wrist strap 550, which extends substantially perpendicularly from an edge of shell 510 to form an adjustable mechanism for fastening hand brace 500 about the forearm of the golfer. Like wrist strap 150, wrist strap 550 may be formed from a flexible, elastic material and may include a recloseable mated fastening system 650 (comprised of first part 650A and second part 650B), as illustrated in FIGS. 6 and 7.

Figure 5:
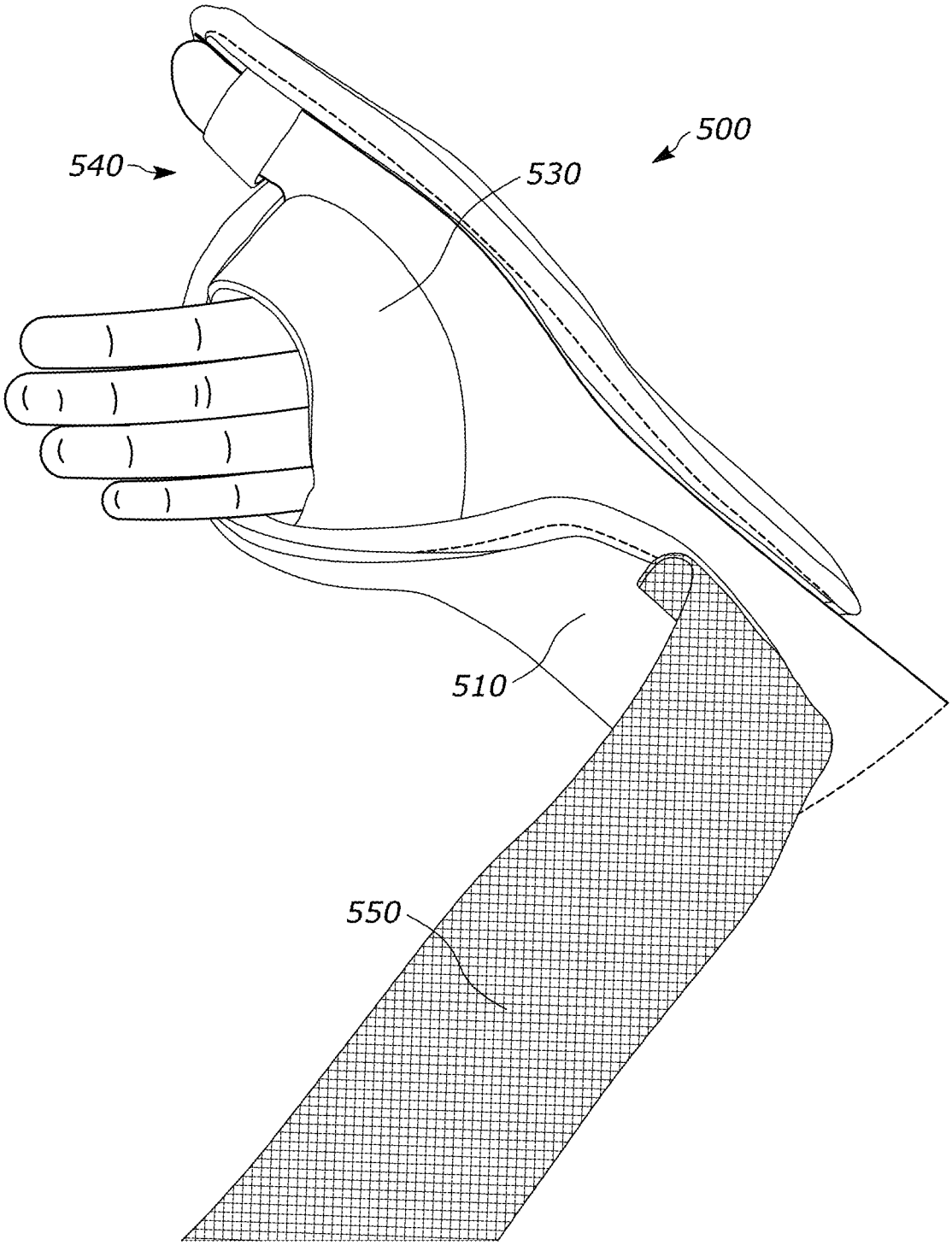
FIG. 5 is a first perspective view illustrating another potential embodiment of the hand brace (500), wherein both the first and second guards are formed with a unified sheet of plastic (517) disposed between the layers of the shell and further illustrates a finger loop (530) configured to receive all four fingers on the golfer's dominant hand.
Figure 8:
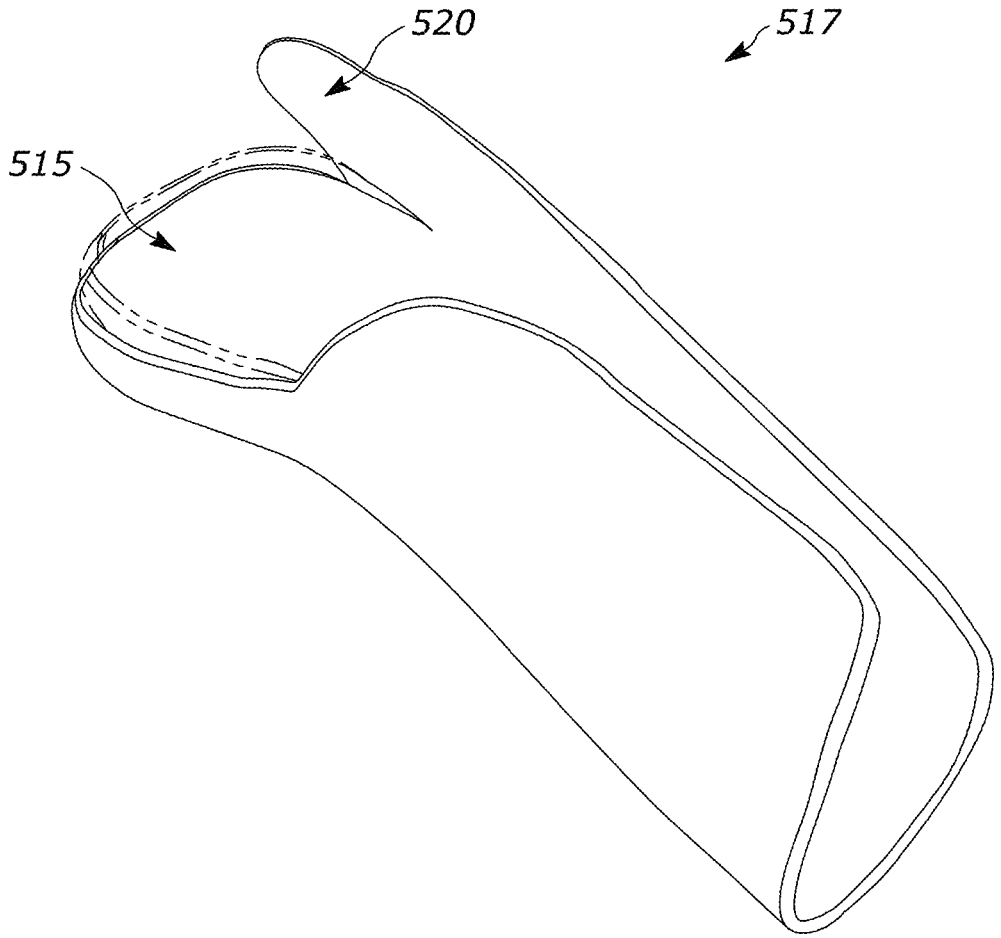
FIG. 8 is a perspective view illustrating the unified sheet of plastic (517) in the embodiment of FIG. 5.

FIG. 8 is a perspective view of the unified sheet of plastic 517 in the embodiment of FIG. 5, illustrating first guard 515 and second guard 520 being formed as part of the sheet. As illustrated, the sheet has been thermoformed on a fixture substantially shaped to mimic a human hand, wrist and forearm. Unified sheet of plastic 517 will preferably be placed inside a shell 510, as described above.

FIG. 5 also illustrates another potential configuration for the finger and thumb loops. As illustrated, the finger loop 530 may be sized to accommodate all four fingers of the dominant hand. As further illustrated, finger loop 530 may be deployed diagonally across the shell 510. It is contemplated in this embodiment, that thumb loop 540 would still be deployed substantially perpendicularly to the thumb.

While hand braces 100 and 500 have been illustrated in the figures for use in association with the right hand, the principles set forth above would be readily applied by a person of ordinary skill in the art having the present specification and drawing before them to the left hand.

It is alternatively contemplated that shell 110 (and 510) may be formed using a continuous sleeve of material. In such embodiments, the inner layer 112 may be physically associated additional padding to decrease the sensation of the first and second guards as they are slid over the golfer's fingers and hand toward positioning them in the manner discussed above in association with the one embodiment in the figures. In this alternative embodiment, there may be no need for a wrist strap 150. Alternatively, a wrist strap might be included to further secure to the hand brace 100 to the golfer's forearm.

While particular embodiments of the present invention have been shown and described, it should be noted that changes and modifications may be made without departing from the presently disclosed inventive concepts in its broader aspects and, therefore, the aim in the appended claims is to cover all such changes and modifications as fall within the true spirit and scope of this invention.

What is claimed is:

1. A hand brace to assist a golfer in improving their short game skills, the hand brace comprising:

a shell configured to cover at least a back portion of a dominant hand, a top portion of a dominant wrist, and a top portion of a dominant forearm of the golfer, the shell having an inner layer and an outer layer and being constructed from at least one flexible material;

a first guard being disposed in association with the shell so that configured to extend along the back of the golfer's dominant hand from and between proximately the second knuckles of the index and ring fingers, over the top of the golfer's dominant wrist and extending toward a lower portion of the golfer's dominant forearm, the first guard being constructed to restrict the maximum extension of the golfer's dominant wrist to less than approximately 20 degrees; and a second guard being disposed in association with the shell so that it configured to extend along the back of the thumb on the golfer's dominant hand from a nailbed of the thumb to the first knuckle of the thumb to substantially restrict radial deviation of the golfer's dominant wrist to less than approximately 10 degrees.

2. The hand brace of claim 1 further comprising a wrist strap extending substantially perpendicularly from an edge of the shell proximate the dominant wrist of the golfer, the wrist strap being substantially formed from a flexible, elastic material, the wrist strap being operatively associated with recloseable mated fastening system.

3. The hand brace of claim 2 further comprising a finger loop for receiving at least two fingers of the dominant hand, the finger loop being a relatively narrow piece of flexible, elastic material attached to opposing sides of the inner layer of the shell to engage the at least two fingers.

4. The hand brace of claim 3 further comprising a thumb loop for receiving the thumb of the dominant hand, the thumb loop being attached to the inner layer of the shell.

5. The hand brace of claim 4 wherein each layer of the shell may be formed from different flexible materials.

6. The hand brace of claim 5 wherein the different flexible materials may be comprised of natural materials, synthetic materials or combinations thereof.

7. The hand brace of claim 6 wherein the first guard is disposed between the inner and outer layers of the shell.

8. The hand brace of claim 7 wherein the first guard is formed from a sufficiently hard material to provide a sufficiently rigid impediment to substantially prevent undesirable extension of the wrist.

9. The hand brace of claim 7 wherein the second guard is disposed between the inner and outer layers of the shell.

10. The hand brace of claim 9 wherein the second guard is formed from a sufficiently hard material to provide a sufficiently rigid impediment to substantially prevent undesirable radial deviation.

11. The hand brace of claim 9 wherein both the first guard and the second guard are formed by a unified sheet of plastic.

12. The hand brace of claim 11 wherein the unified sheet of plastic is a styrene sheet.

13. The hand brace of claim 12 wherein the styrene sheet has a layer of open cell foam disposed on at least a face of the styrene sheet disposed closest to the dominant hand of the golfer.

14. The hand brace of claim 2 wherein the recloseable mated fastening system is a hook and loop closure.

15. The hand brace of claim 1 further comprising a finger loop for receiving at least two fingers of the dominant hand, the finger loop being a relatively narrow piece of flexible, elastic material attached to opposing sides of the inner layer of the shell to engage the at least two fingers.

16. The hand brace of claim 15 further comprising a thumb loop for receiving the thumb of the dominant hand, the thumb loop being attached to the inner layer of the shell.

* * * * *